US005762509A

United States Patent [19]

Kang

[11] Patent Number: 5,762,509

[45] Date of Patent: Jun. 9, 1998

[54] BALLAST CASING FOR FLUORESCENT LAMP

[75] Inventor: Bog Youn Kang, Cheongju, Rep. of Korea

[73] Assignee: LG Industrial Systems Co., Ltd., Seoul, Rep. of Korea

[21] Appl. No.: 702,213

[22] Filed: Aug. 23, 1996

[30] Foreign Application Priority Data

Sep. 2, 1995 [KR] Rep. of Korea ..... 28692/1995

[51] Int. Cl.[6] ..... H01R 33/02

[52] U.S. Cl. ..... 439/232; 439/76.1; 174/DIG. 2

[58] Field of Search ..... 439/76.1, 226, 439/227, 232, 404, 460; 174/DIG. 2

[56] References Cited

U.S. PATENT DOCUMENTS 4,729,740 3/1988 Crowe et al. ..... 439/76.1

5,350,316 9/1994 Van Wagener et al. ..... 439/460

5,364,288 11/1994 Drewanz et al. ..... 439/404

*Primary Examiner*—Gary F. Paumen

*Assistant Examiner*—T. C. Patel

*Attorney, Agent, or Firm*—Oliff & Berridge, PLC

[57] ABSTRACT

A stabilizer casing for a fluorescent light fixture includes an open lower case, a printed circuit board mounted in the open lower case, a connector connected to a portion of the printed circuit board and having connection terminals, and a cap connected to the open lower case so that the connection terminals of the connector are exposed externally at one end of the cap. The stabilizer can be easily automated and cost reduction can be accomplished accordingly due to the simplified production steps.

5 Claims, 11 Drawing Sheets

BALLAST CASING FOR FLUORESCENT LAMP

BACKGROUND OF THE INVENTION

1. Field of the Invention

The present invention relates to a ballast casing for a fluorescent lamp, and more particularly to a ballast for a fluorescent lamp capable of preventing a connector thereof from unwanted movement, as well as facilitating assembly of the connector into the casing by means of modifying the conventional casing, the connector and a socket.

2. Description of the Prior Art

A ballast is an electrical component of a fluorescent lighting device which assists the electrical operation of the lighting device, and includes certain electrical elements mounted and connected within a casing which is in turn mounted and connected to a fluorescent lamp.

As shown in FIGS. 1 through 6, a conventional ballast casing for a fluorescent lamp is provided with a case 1 having a certain shape and a connector 13 for being mounted to a portion of the case 1.

Extending from each side of a bottom plate 2 of the case 1 there is formed a side wall 3 bent upwardly to a certain extent. At each corner end of the side walls 3 there is provided a notch 4 for receiving the connector 13 thereon.

A bending plate 5 is formed extendedly from the bottom plate 2. The bending plate 5 is upwardly bent at a first bend 6 so that the bending plate 5 can be contacted to a corresponding edge of each of the side walls 3.

At level of the case 1 when the bending plate 5 is upwardly bent, it is outwardly bent at a second bend 7. At each side of the bending plate 5 there is formed a retaining plate 8 to be bent toward a corresponding edge of each of the side wall 3, for thus preventing the connector 13 mounted in the notches 4 from being wobbled right and left.

A slot 9 is formed in a portion of the bending plate 5 surface between the first bend 6 and the second bend 7, so that a portion of the connector 13 being mounted on the notches 4 can be exposed therethrough. At a lower portion of the slot 9 there is formed a notch 10 extended from the slot 9.

Mounting holes 12 are formed in each corner of a mounting plate portion 11 extending from the second bend 7.

On each side of the connector 13 there is provided a mounting ear 14 for being mounted into a corresponding one of the notches 4 in the case 1. A plurality of connection terminals 15 are provided in the middle of the connector 13.

Below the connection terminals 15 there is formed a recess 16 for receiving a connection part of a socket (not shown) being inserted therein through the notch 10 in the case 1. A plurality of connector wires 17 extend from the rear of the connector 13.

In the middle of the case 1 there is installed an inner element 19 from which a plurality of connector terminals 18 are extended.

The assembly steps for the thusly composed ballast casing for a fluorescent lamp will now be described.

First, the mounting ears 14 of the connector 13 are each mounted in a notch 4. The bending plate 5 is upwardly bent at the first bend 6 so that the connector 13 cannot be moved back and forth. At this time, the connection terminals 15 in the connector 13 are exposed through the slot 9.

The retaining plates 8 at each side of the bending plate 5 are bent toward the side walls 3 of the case 1 to prevent the, connector 13 from moving left and right. Then, the mounting plate portion 11 is outwardly bent at the second bend 7, thus becoming even with the level of the upper edge line of the side walls 3. The plurality of connector wires 17 are connected to the connector terminals 18, thereby completing the assembly process.

The ballast casing assembled as above is mounted by screws fastened through the mounting holes 12 to a portion of the fluorescent lamp.

However, the previously described conventional ballast casing for a fluorescent lamp has a disadvantage, in that parts of the case 1 must be bent multiple times to fix the connector 13 therein. As a result, too much time is required due to the multiple bending steps.

Further, the fabrication steps are complicated because the connector wires 17 must be connected to the corresponding connector terminals 18 extended from the inner element 19.

Still further, the increased cost of the connector 13 due to the formation of the recess 16 for receiving a socket has been another disadvantage.

SUMMARY OF THE INVENTION

Therefore, it is an object of the present invention to provide a ballast casing for a fluorescent lamp capable of easily assembling a connector into the casing by modifying the shapes of the connector and a socket needed therein.

It is another object of the present invention to provide a ballast casing for a fluorescent lamp for preventing the unwanted movement of the connector.

To achieve the above-described objects, the ballast casing for a fluorescent lamp in accordance with the present invention includes an open lower case, a printed circuit board mounted in the open lower case, a connector connected to a portion of the printed circuit board and having connection terminals, and a cap connected to the open lower case so that the connection terminals of the connector are exposed externally at one end of the cap.

BRIEF DESCRIPTION OF THE DRAWINGS

in FIG. 3;

DETAILED DESCRIPTION OF THE PRESENT INVENTION

Figure 1:
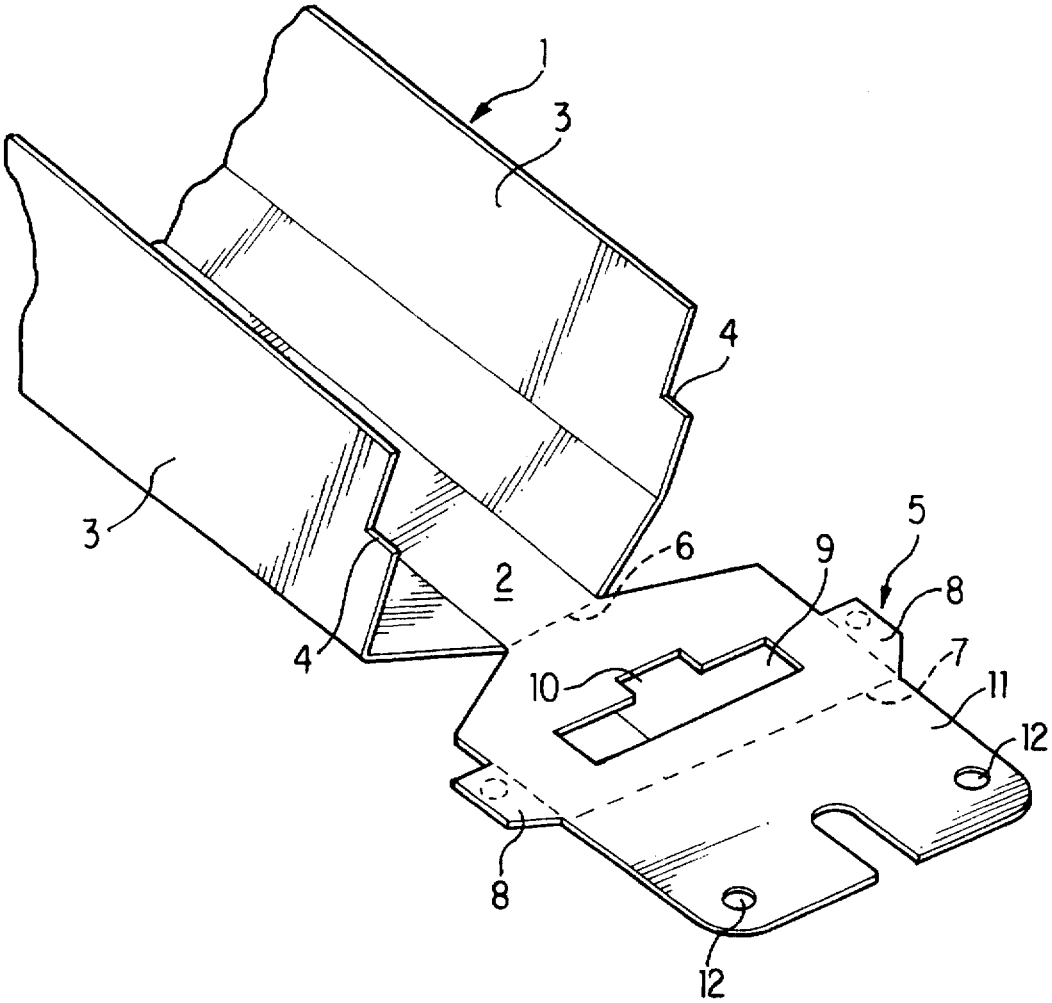
FIG. 1 PRIOR ART
FIG. 1 is a perspective view showing an open case of a conventional ballast casing for a fluorescent lamp.
Figure 2:
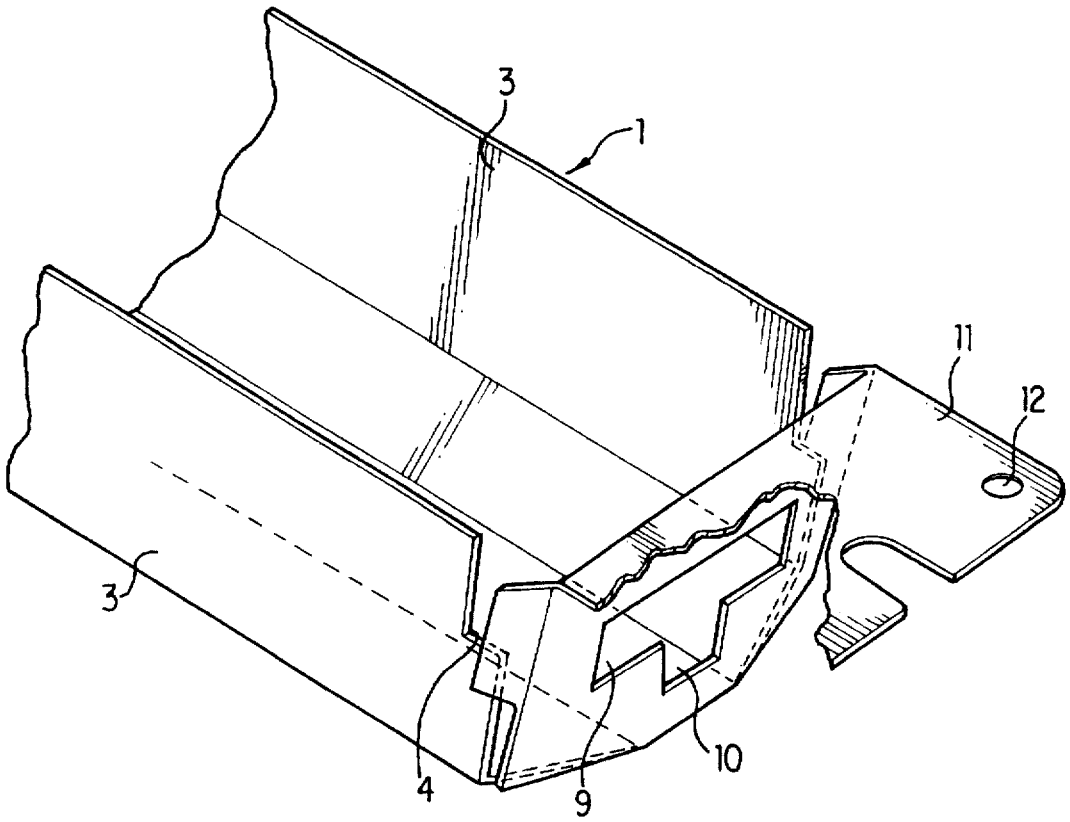
FIG. 2 PRIOR ART
FIG. 2 is a perspective view showing a folded case of the conventional ballast casing.
Figure 3:
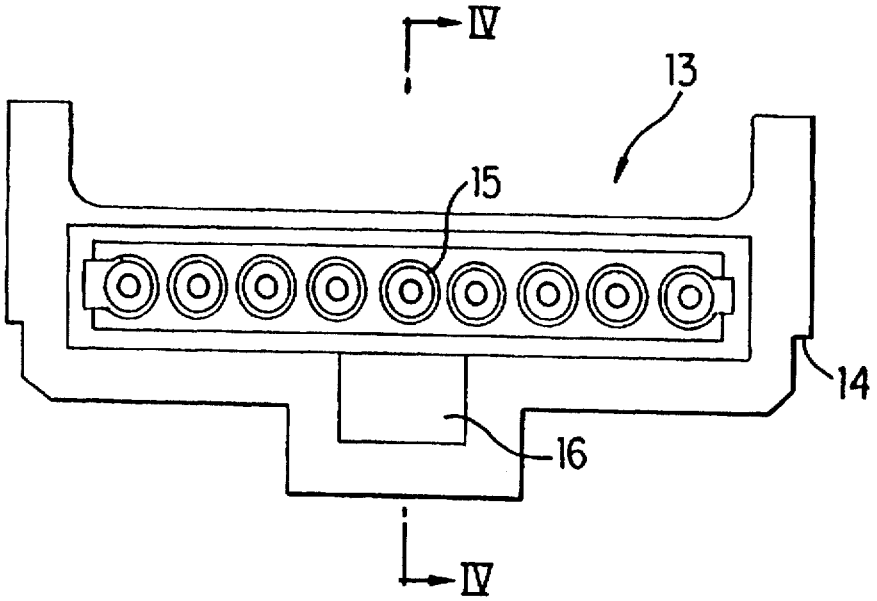
FIG. 3 PRIOR ART
FIG. 3 is a front view of the conventional ballast casing.
Figure 4:
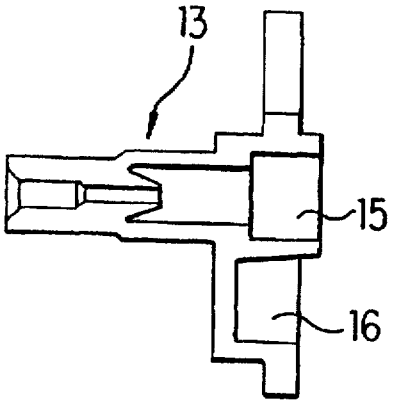
FIG. 4 PRIOR ART
FIG. 4 is a cross-sectional view taken along the line IV—IV.
Figure 5:
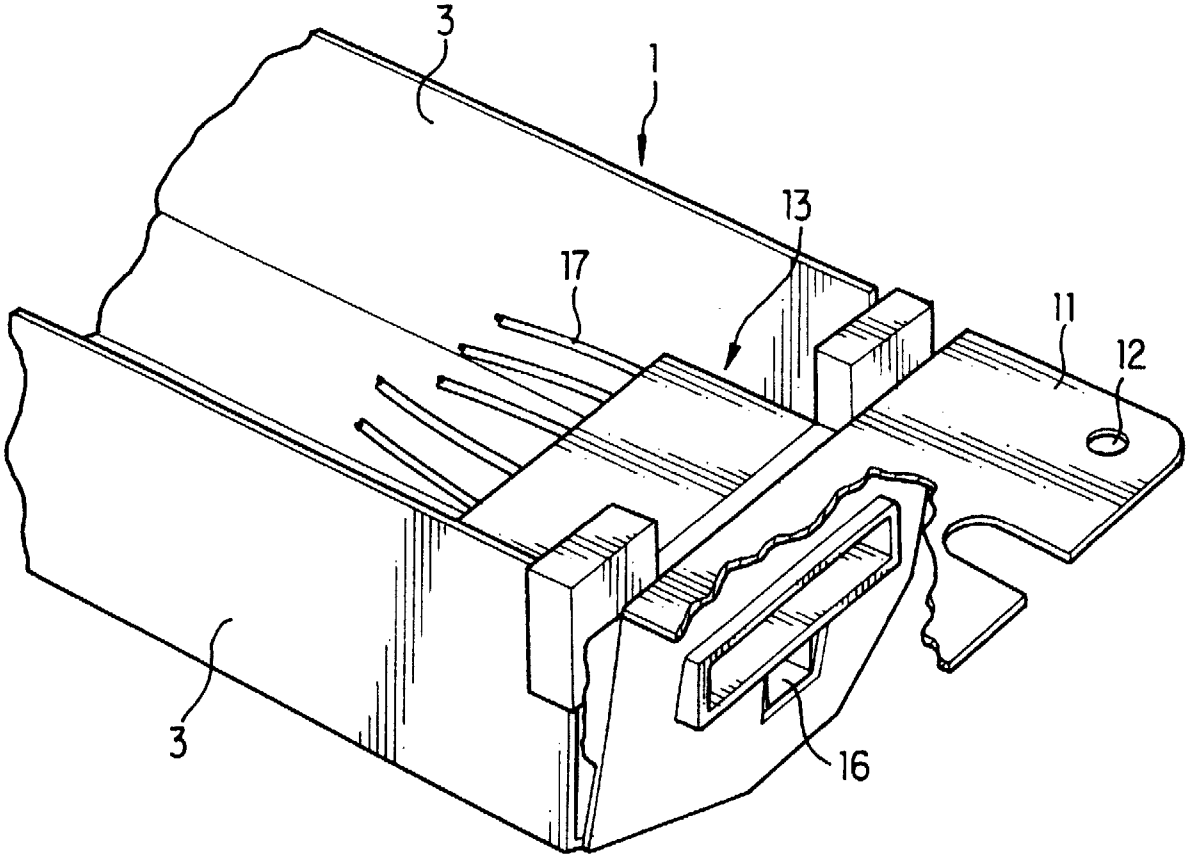
FIG. 5 PRIOR ART
FIG. 5 is a perspective view of the conventional ballast casing having a connector mounted therein.
Figure 6:
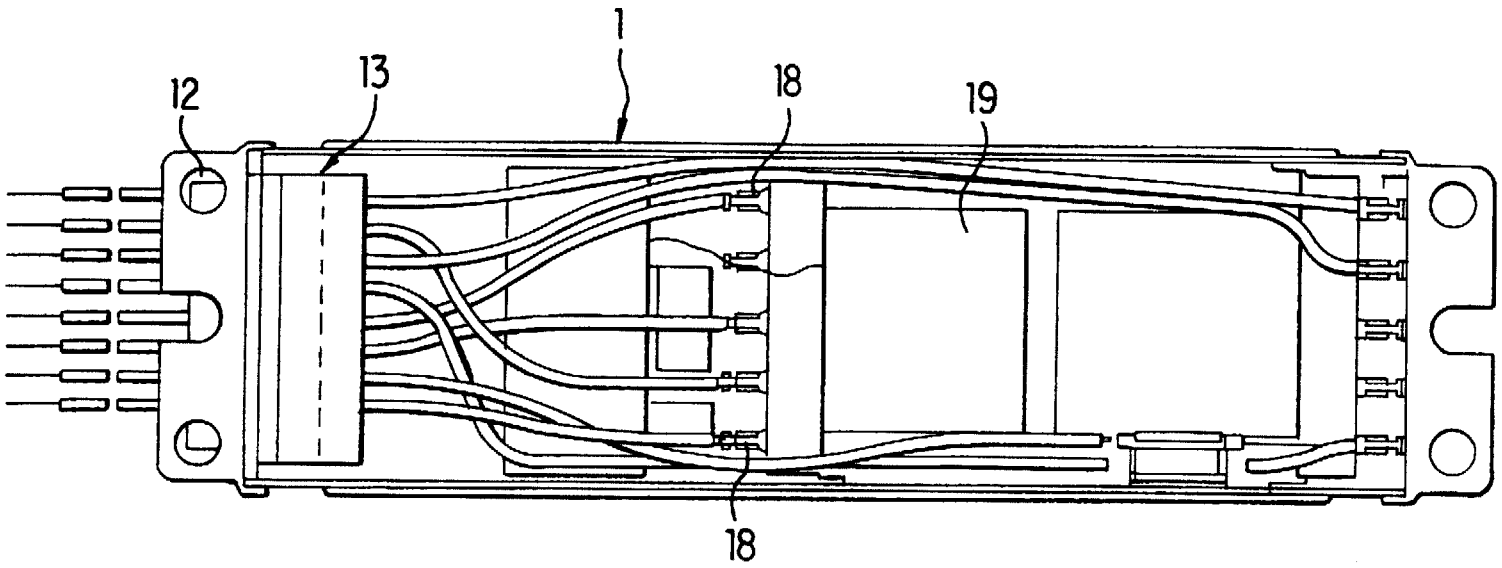
FIG. 6 PRIOR ART
FIG. 6 is a plan view of the assembled conventional ballast casing.

With reference to FIGS. 7 through 18, a ballast casing for a fluorescent lamp in accordance with the present invention includes several parts: an open lower case 30, a printed circuit board 40, a connector 50, a cap 60 and a socket 70.

Figure 7:
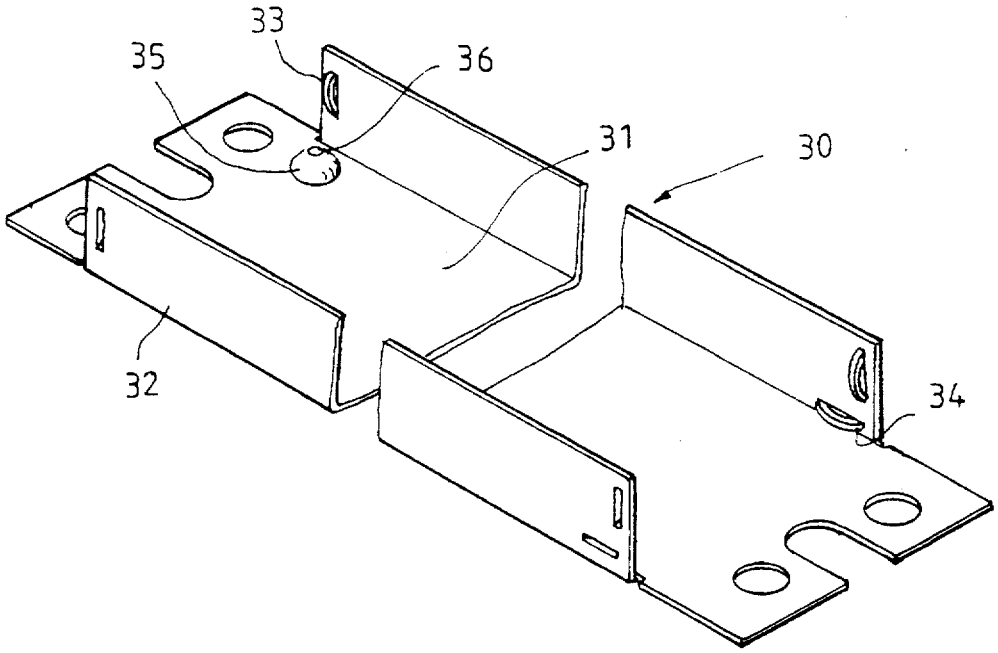
FIG. 7 is a perspective view showing a open lower case of a ballast casing for a fluorescent lamp in accordance with the present invention.

As shown in FIG. 7, the open lower case 30 has a rectangular shaped bottom 31 having a longer length than a width thereof. Along each long side of the bottom 31 there is formed a side wall 32 extended upwardly from each side of the bottom 31 but not extended to each end of the bottom 31.

In the ends of the side walls 32 there are vertically formed a pair of semicircular connection protrusions 33 inwardly projected from the side walls 32, and semicircular horizontal protrusions 34 are also formed projecting inwardly in the lower portion of each end of the side walls 32.

A boss 35 is formed on a portion of the bottom 31, extending even with the horizontal protrusions 34. In the center of the boss 35 there is formed a mounting hole 36. At each end of the bottom 31 there are formed mounting holes 37.

Figure 8:
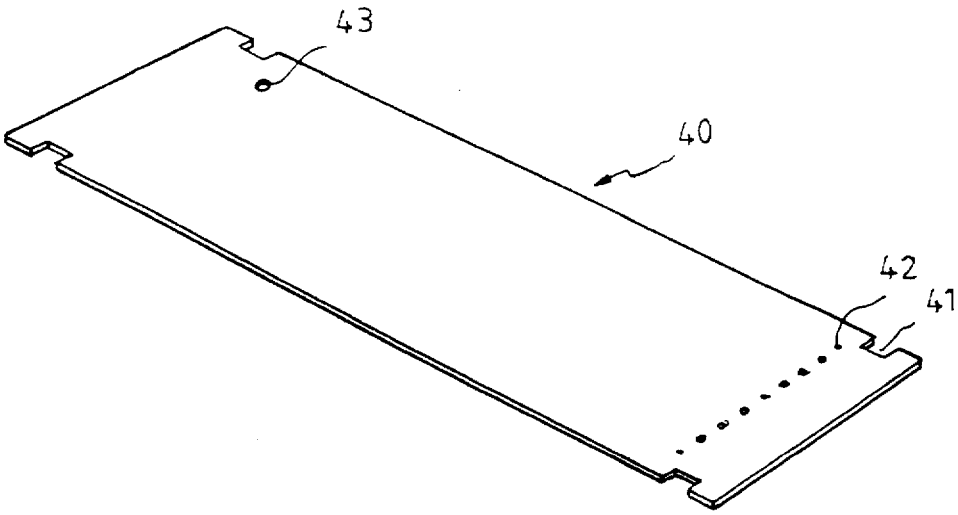
FIG. 8 is a perspective view showing a printed circuit board of the ballast casing in accordance with the present invention.

As shown in FIG. 8, a pair of notches 41 are provided in each corner at the side of the printed circuit board 40 to clear the protrusions 33. A plurality of connection holes 42 are formed in a row across one end of the printed circuit board 40 so that pins of the connector 50 can be inserted therethrough.

A mounting hole 43 positioned corresponding to the mounting hole 36 in the case bottom 31 is formed at a portion of the printed circuit board 40.

Figure 9:
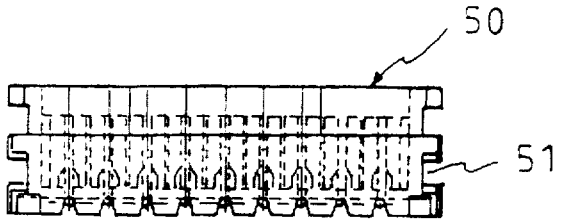
FIG. 9 is a plan view showing a connector of the ballast casing in accordance with the present invention.
Figure 10:
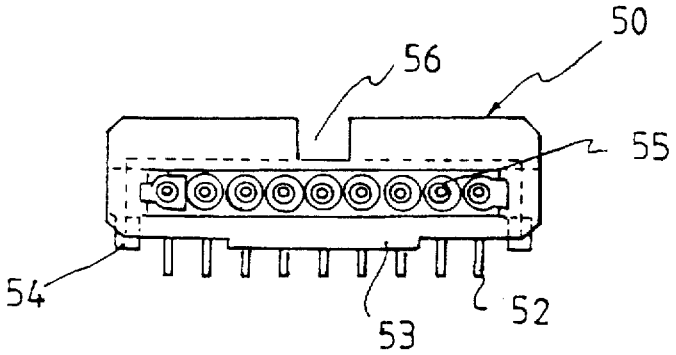
FIG. 10 is a front view of the connector of FIG. 9.
Figure 11:
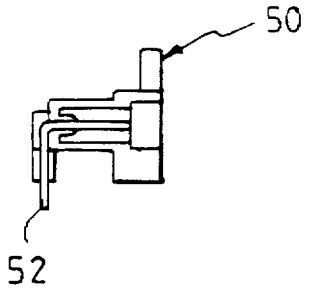
FIG. 11 is a cross-sectional view of the connector of FIG. 9.

As shown in FIGS. 9–11, the connector 50 has notches 51 in each end thereof, for clearing the protrusions 33 therethrough. A plurality of connection pins 52 are each extended downwardly from the body of the connector 50 for being inserted into the corresponding connection holes 42 in the printed circuit board 40.

The body of the connector 50 includes a flat horizontal front support 53 for abutting to the printed circuit board 40 on being contacted thereto, extended downwardly from the connector 50. Depending from each end of the connector body there is also formed a rear support leg 54 extending to the same level as the front support 53.

A plurality of connection terminals 55 are mounted in the middle of the connector 50 so as to be connected to corresponding portions of the socket 70. A hook opening 56 is formed in the upper surface of the connector 50 for receiving a hook portion of the socket 70.

Figure 12:
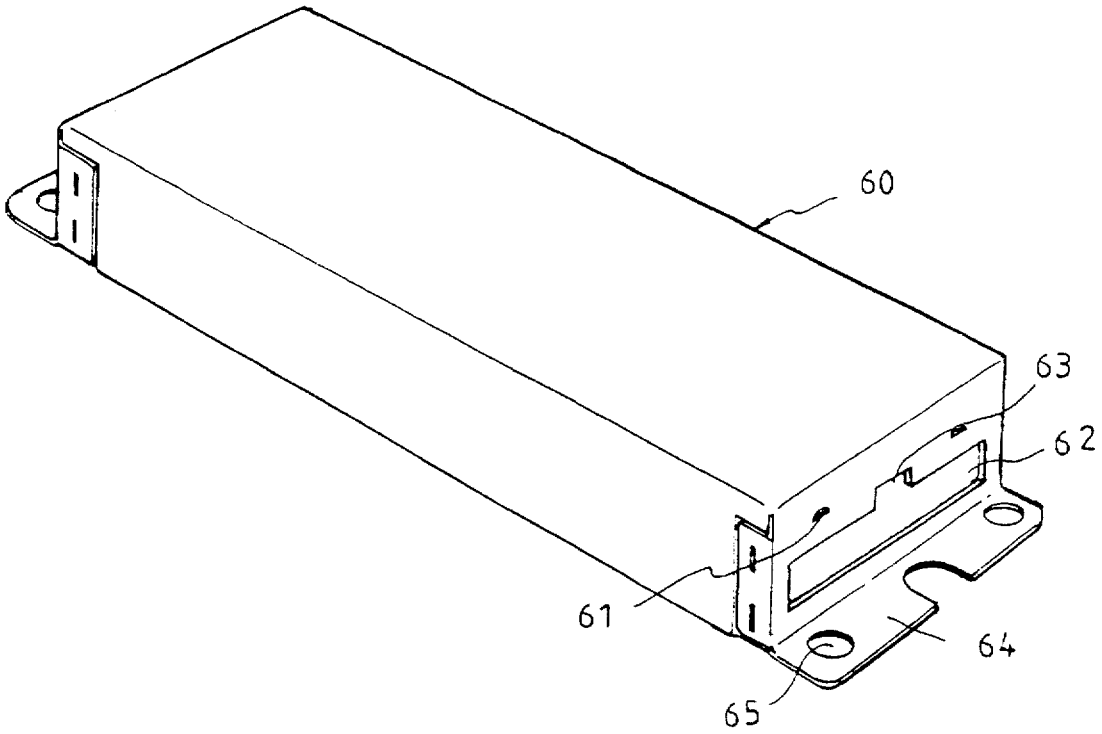
FIG. 12 is a perspective view showing a cap combined to the open lower case of the ballast casing in accordance with the present invention.
Figure 13:
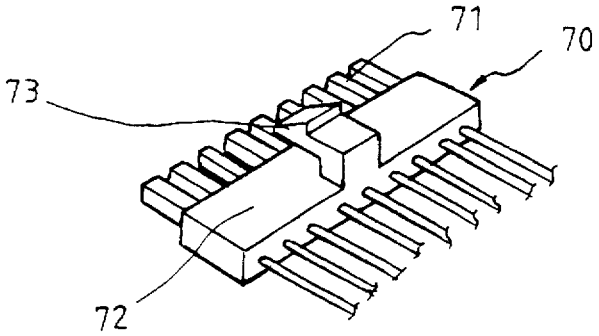
FIG. 13 is a perspective view showing a socket of the ballast casing in accordance with the present invention.
Figure 14:
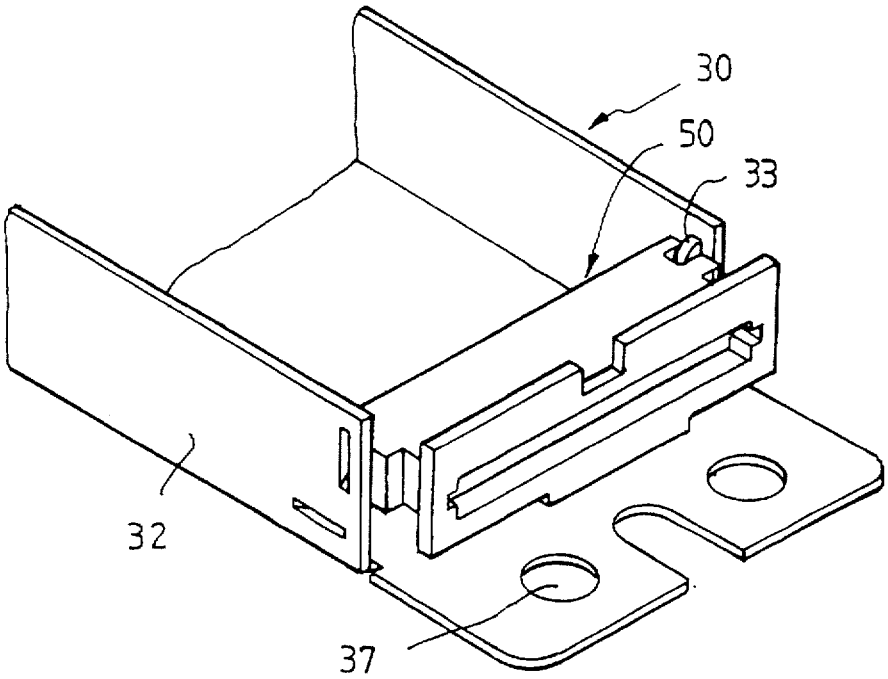
FIG. 14 is a perspective view showing the open lower case having the connector mounted therein in accordance with the present invention.
Figure 15:
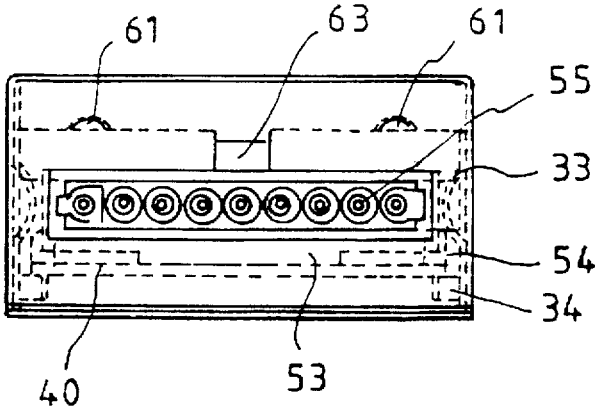
FIG. 15 is an end view of the ballast casing in accordance with the present invention.
Figure 16:
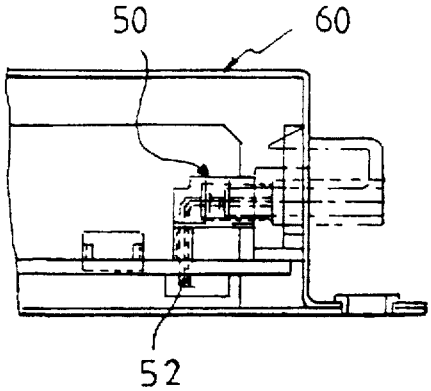
FIG. 16 is a partial side cross-sectional view of the ballast casing in accordance with the present invention.
Figure 17:
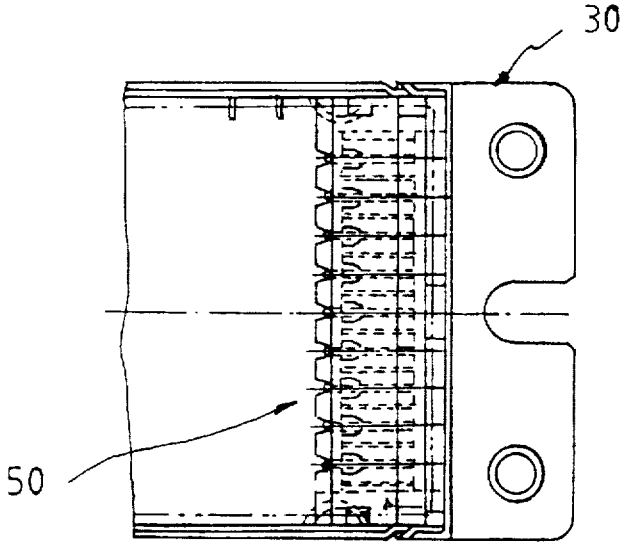
FIG. 17 is a partial plan cross-sectional view of the ballast casing in accordance with the present invention.
Figure 18:
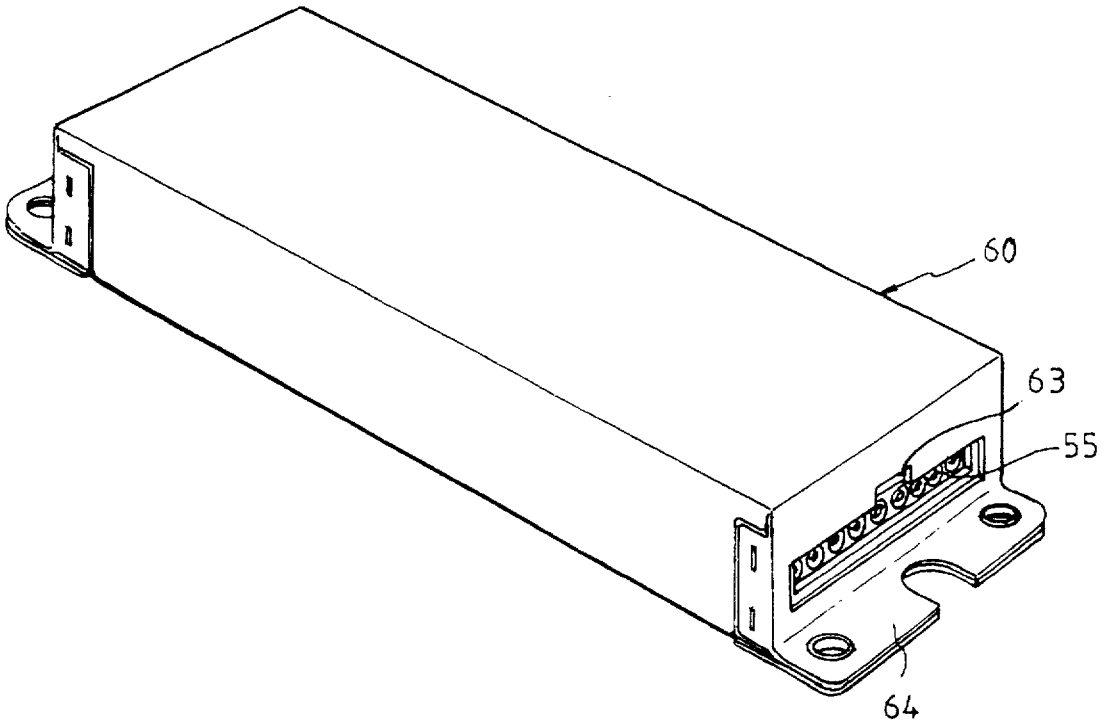
FIG. 18 is a perspective view of the ballast casing in accordance with the present invention.

As shown in FIG. 12, the cap 60 is formed as a rectangular box having an open bottom, and sized to fit over and close the open lower case 30.

A plurality of projecting tabs 61 are formed extending inwardly from one end of the cap 60 for holding the connector 50 tightly in the open lower case 30 when assembled thereto. A connection slot 62 is formed in the cap end below the tabs 61 so that the connection terminals 55 can be exposed therethrough when the connector 50 is assembled to the open lower case 30.

A hook notch 63 extends upwardly from the center of the connection slot 62. A contact plate 64 is extended outwardly from a lower edge of each end of the cap 60 so as to be attached to the open lower case 30 when combined thereto.

A pair of mounting holes 65 are each formed in each contact plate 64 so as to correspond to the mounting holes 37 in the open lower case 30.

The support legs 54 on the connector 50 and the tabs 61 on the cap 60 each serve to prevent vertical movement of the connector 50.

The socket 70 is shaped as an oblong block having a hook 73 extended from the top surface thereof so that an insertion body 72 carrying a plurality of terminals 71 extending therefrom can be inserted into the connection slot 62. The hook 73 is provided to be hooked into the hook notch 63.

The assembly of the ballast casing construction for a fluorescent lamp in accordance with the present invention will be explained, as follows.

First, the connector 50 is mounted on the printed circuit board 40 so that the connection pins 52 can be inserted through the connection holes 42 and connected thereto using a technique such as soldering. At this time, the notches 51 are each engaged over a corresponding one of the protrusions 33, thus preventing the connector 50 from moving back and forth, and the supports 53, 54 on the connector 50 are abutted to the printed circuit board 40 which accordingly remains horizontal.

Next, the printed circuit board 40 with the connector 50 thereon is inserted over the protrusions 33 into the lower open case 30 so as to be mounted on the horizontal protrusions 34 and the boss 35 and is then fastened to the lower case 30 by screwing a bolt sequentially into the connection hole 43 and the connection hole 36 provided in the center of the boss 35.

Thereafter, the cap 60 is placed over the open lower case 30 and the connection terminals 55 are exposed through the connection slot 62. The tabs 61 together with the supports 53, 54 in the connector 50 serve to prevent up-and-down movement of the connector 50. The contact plates 64 of the cap 60 are each attached to each end of the case 30, wherein each of the mounting holes 37 corresponds to each of the mounting holes 65.

During the insertion of the socket 70 through the connection slot 62 and the hook notch 63, the insertion body 72 of the socket 70 is passed through the connection slot 62 and the plurality of terminals 71 are inserted into corresponding ones of the connection terminals 55 in the connector 50. The hook 73 is hooked upwardly in the hook notch 63 of the cap 60.

The thusly completed ballast casing is mounted through the mounting holes 37, 65 to a portion of a fluorescent lamp by screws.

As described above, the ballast casing for a fluorescent lamp in accordance with the present invention has the advantages that the thusly simplified production steps can be easily automated and cost reduction can be accomplished accordingly.

Further, improved product reliability can be realized by preventing the connector from moving in the case by means of fixing the same stably by employing the cap and the open lower case.

What is claimed is:

1. A ballast casing for a fluorescent lamp, comprising:

an open lower case which comprises:

a rectangular bottom;

side walls extended from each side thereof but ending short of each end of the bottom;

a vertical projection inwardly extended from each end of each of the side walls;

a horizontal projection inwardly extended from each end of each side wall below the vertical projections;

a boss formed on a portion of the bottom and having the same height as each of the horizontal projections;

a first mounting hole formed in a center of the boss; and a plurality of second mounting holes formed in each end portion of the bottom;

a printed circuit board mounted in the open lower case;

a connector connected to a portion of the printed circuit board and having connection terminals; and a cap connected to the open lower case so that the connection terminals of the connector are exposed externally at one end of the cap.

2. The ballast of claim 1, wherein the printed circuit board has notches formed in each corner at a side thereof to clear the vertical projections, first connection holes formed in a row across one end thereof, and a second connection hole formed at a portion thereof to correspond to the first mounting hole.

3. The ballast of claim 1, wherein the connector has notches in each end thereof for clearing the vertical projections therethrough, a plurality of connection pins each extended downwardly from the body thereof for being inserted into corresponding holes in the printed circuit board, a flat horizontal front support downwardly extended therefrom for abutting to the printed circuit board, a rear support leg depending from each end of the connector body and extending to the same level as the front support, a plurality of connection terminals formed in the middle thereof so as to be connected to corresponding portions of a socket, and a hook opening formed in an upper surface thereof for receiving a hook portion of the socket.

4. The ballast of claim 3, wherein the socket has an insertion body carrying a plurality of terminals extending therefrom for being inserted into the connection slot in the cap, and a hook formed extending upwardly from the insertion body for being hooked in a hook notch of the cap.

5. The stabilizer of claim 3, wherein the flat horizontal front support of the connector is formed to prevent the connector from vertical movement.

* * * * *